US007758372B2

(12) United States Patent
Jaouen et al.

(10) Patent No.: US 7,758,372 B2
(45) Date of Patent: Jul. 20, 2010

(54) CONDUCTOR WITH SIMPLIFIED ASSEMBLY FOR MULTI-CONDUCTOR CABLE

(75) Inventors: Jean-Marc Jaouen, La Sonc (FR); Didier Revol, Chatte (FR); Vincent Laroche, Saint-Marcellin (FR); Nathalie Foratier, Saint Antoine I'Abbaye (FR)

(73) Assignees: Legrand France, Limoges (FR); Legrand SNC, Limoges (FR)

( * ) Notice: Subject to any disclaimer, the term of this patent is extended or adjusted under 35 U.S.C. 154(b) by 101 days.

(21) Appl. No.: 12/268,508

(22) Filed: Nov. 11, 2008

(65) Prior Publication Data

US 2009/0124109 A1 May 14, 2009

(30) Foreign Application Priority Data

Nov. 13, 2007 (FR) ..... 07 07982

(51) Int. Cl.
*H01R 4/26* (2006.01)

(52) U.S. Cl. ..... 439/409

(58) Field of Classification Search ..... 439/409, 439/417, 399, 389, 676; 174/358, 359
See application file for complete search history.

(56) References Cited

U.S. PATENT DOCUMENTS 4,062,616 A * 12/1977 Shaffer et al. ..... 439/399
5,947,761 A * 9/1999 Pepe ..... 439/409
6,646,197 B1 * 11/2003 Cugalj et al. ..... 174/355
6,660,932 B1 * 12/2003 Barringer et al. ..... 174/358
2002/0094715 A1 * 7/2002 Pepe et al. ..... 439/417
2003/0049961 A1 * 3/2003 Tricaud et al. ..... 439/417
2004/0229517 A1 * 11/2004 Bush et al. ..... 439/676
2006/0148199 A1 7/2006 Kim
2008/0096416 A1 * 4/2008 Wedler et al. ..... 439/389
2010/0064503 A1 * 3/2010 Chen ..... 29/566.4

FOREIGN PATENT DOCUMENTS

FR 2253290 6/1975
FR 2899028 A1 9/2007
GB 2436898 A 10/2007
WO WO 01/50548 A1 7/2001

* cited by examiner

*Primary Examiner*—Alexander Gilman
(74) *Attorney, Agent, or Firm*—Harness Dickey & Pierce, PLC

(57) ABSTRACT

The invention concerns a connector designed to be fitted to a multi-conductor cable and which comprises at least one socket, a cable grip formed by a portion connected to the socket and a free portion articulated on the connected portion, and assembly means. The assembly means comprise a lever articulated around an articulation axis, held by the socket and distant from the articulation axis of the grip, wherein this lever has a curved end that may exert on the external surface of the free portion of the grip a thrust force which solicits the grip when closing in response to the application, on the lever, of a rotational torque around the articulation axis.

8 Claims, 5 Drawing Sheets

CONDUCTOR WITH SIMPLIFIED ASSEMBLY FOR MULTI-CONDUCTOR CABLE

FIELD

This invention concerns, in general, the field of connectors, and in particular that of connection accessories designed for computer applications.

BACKGROUND

More precisely, the invention concerns a connector designed to be fitted to a multi-conductor cable and which comprises a cable grip, a socket and assembly means, wherein the socket is equipped with a plurality of internal contacts and has a connector face designed to accommodate a multi-conductor removable plug, wherein the grip forms a stack with the socket and comprises a portion that is connected to the socket, a free portion, a rack held on one of the free and connected portions, possibly a counter-rack held on the other one of the free and connected portions, and a plurality of self-stripping electrical contacts held by one of the free and connected portions, wherein the free portion has an passage designed to allow the cable to pass in a longitudinal axis and is articulated on the connected portion around a first articulation axis to permit selectively the opening or closing of the grip, wherein the rack has notches, each of which is dimensioned to hold a corresponding insulated conductor of the cable, wherein each of the self-stripping contacts is electrically connected with a corresponding internal contact of the socket and is adapted to accommodate and strip, during a phase where the connector is assembled, including the closing of the grip, a corresponding insulated conductor of the cable, and the assembly means which provide, in the assembled configuration of the connector, a reversible attachment of the free and connected portions of the grip.

A connector of this type is for example described in the patent application WO 01/50548.

One of the problems to be resolved in this type of connector consists of reducing the force to be applied to close the grip, as this movement requires the energy required to strip each of the conductors of the cable.

A principle that is implemented in the above-mentioned patent application, that is also well known from the patent FR 2 253 290, consists of spacing the self-stripping contacts at increasing distances from the first articulation axis, so that the conductors are stripped one after the other during the grip closing operation, rather than stripping them all at the same time.

Nevertheless, in practice, such a measure is not sufficient to provide this type of assembly with a satisfactory level of comfort for tradesmen who assemble a considerable number of connectors each day.

SUMMARY

The purpose of this invention, which is situated in this context, is to propose a connector that does not have this defect.

For this purpose, the connector of the invention, which is furthermore compliant with the generic definition provided in the above preamble, is essentially characterised in that the assembly means comprise a second articulation axis and a lever, in that the second articulation axis is held by the socket and distant from the first articulation axis along the longitudinal axis and/or transversally to the longitudinal axis, and in that the lever has a first end that is articulated around the second articulation axis and a second end, distant from the first and curved, wherein the free portion of the grip has an external surface that is conformed into a slope to transform, in the assembly phase, a rotational torque applied to the lever around the second articulation axis into a thrust force from the curved end of the lever which solicits the grip when closing.

The ergonomics of the lever of the invention are further improved by providing for the lever to include, between its ends, a flat median section.

Preferably, the external surface of the free portion of the grip and the curved end of the lever have respective sections in relief that are complementary to one another so as to be clipped together.

In the case of the stack formed by the grip and the socket is substantially parallelepipedal, the portion connected to the grip may be connected to the socket at the opposite side to the connection face of this socket.

Furthermore, the first and second articulation axes may be substantially positioned on two diagonally opposed corners of the parallelepipedal stack.

In one possible embodiment, the self-stripping contacts are held on the portion connected to the grip.

Finally, even though the passage may be formed by an orifice passing through the free portion of the grip, it may also be in the form of a notch.

DRAWINGS

Other features and advantages of the invention will become clearer upon reading the following description, by way of illustrative and non-restrictive example, in reference to the appended drawings in which.

DETAILED DESCRIPTION

Figure 1:
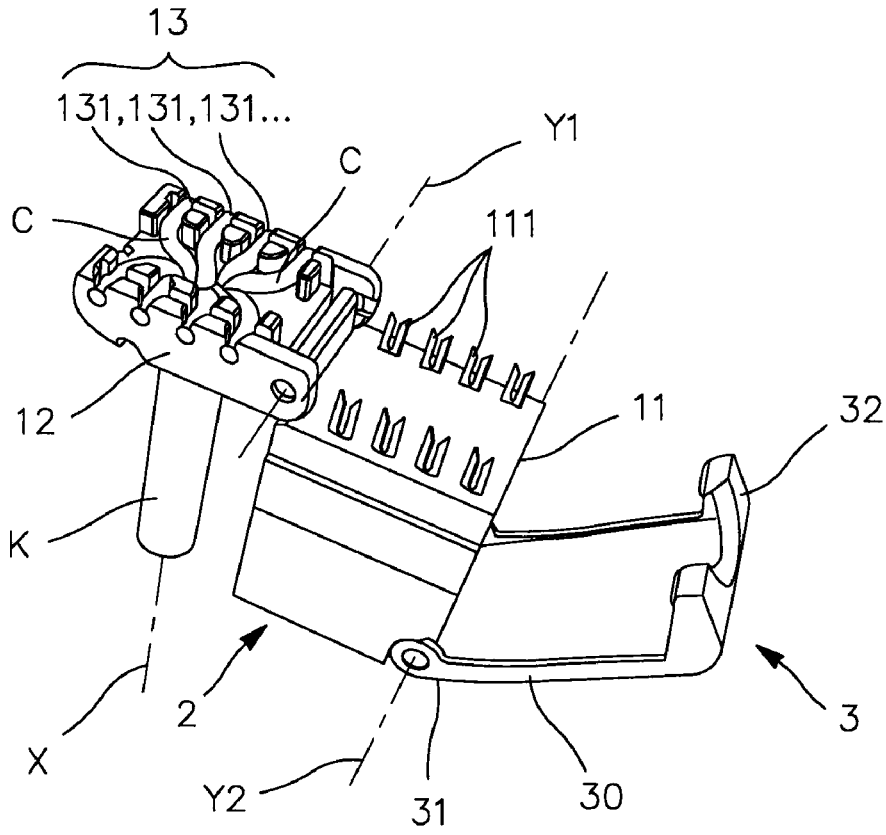
FIG. 1 is a perspective view of a connector according to a first possible embodiment of the invention, shown equipped with a cable and in the open configuration of the grip.
Figure 2:
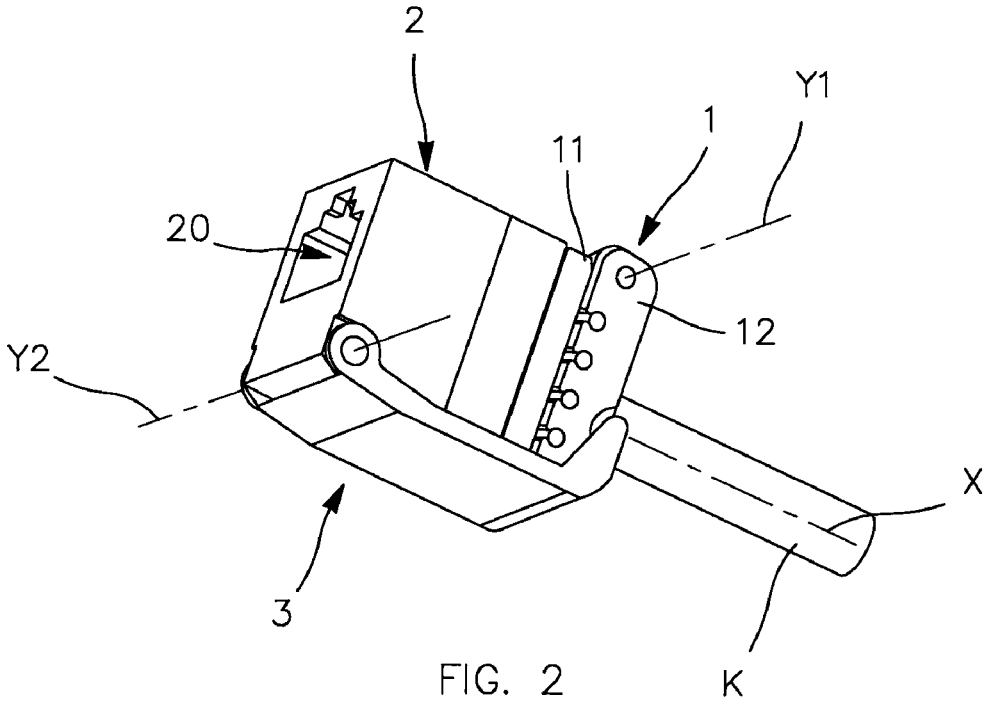
FIG. 2 is a perspective view of a connector according to the first possible embodiment of the invention, shown equipped with a cable and in the closed configuration of the grip.

As previously stated, the invention concerns a connector designed to be fitted to a multi-conductor cable K and which comprises at least (FIG. 2) a cable grip 1, a socket 2 and assembly means which will be detailed below, and which are more especially the subject matter of the invention.

The socket 2 is equipped with a plurality of internal contacts with spring blades (not shown) and has a connection face 20 designed to accommodate a removable multi-conductor plug, typically formed by an RJ11 or RJ45 plug in the preferred application of the invention.

The grip 1 forms a stack with the socket 2 and comprises a portion 11 connected to the socket 2, a free portion 12, a rack 13, possibly a counter-rack 14 and a plurality of self-stripping electrical contacts 111.

The connected portion 11 of the grip 1 is for example attached to the socket 2 by a clip fastening opposite the connection face 20 of this socket 2.

The free portion 12 has a passage 120 which allows the cable K to pass through, in a longitudinal axis X. This passage may be formed by a central orifice, as shown for example in FIG. 3, or be in the form of a notch opening onto one side of this free portion, as shown in FIG. 9.

This free portion 12 is furthermore articulated on the connected portion 11 around an articulation axis Y1 to allow the grip 1 to adopt an open or closed configuration.

The rack 13 is formed by a plurality of notches 131, each of which is dimensioned to hold a corresponding insulated conductor C of the cable K.

Figure 9:
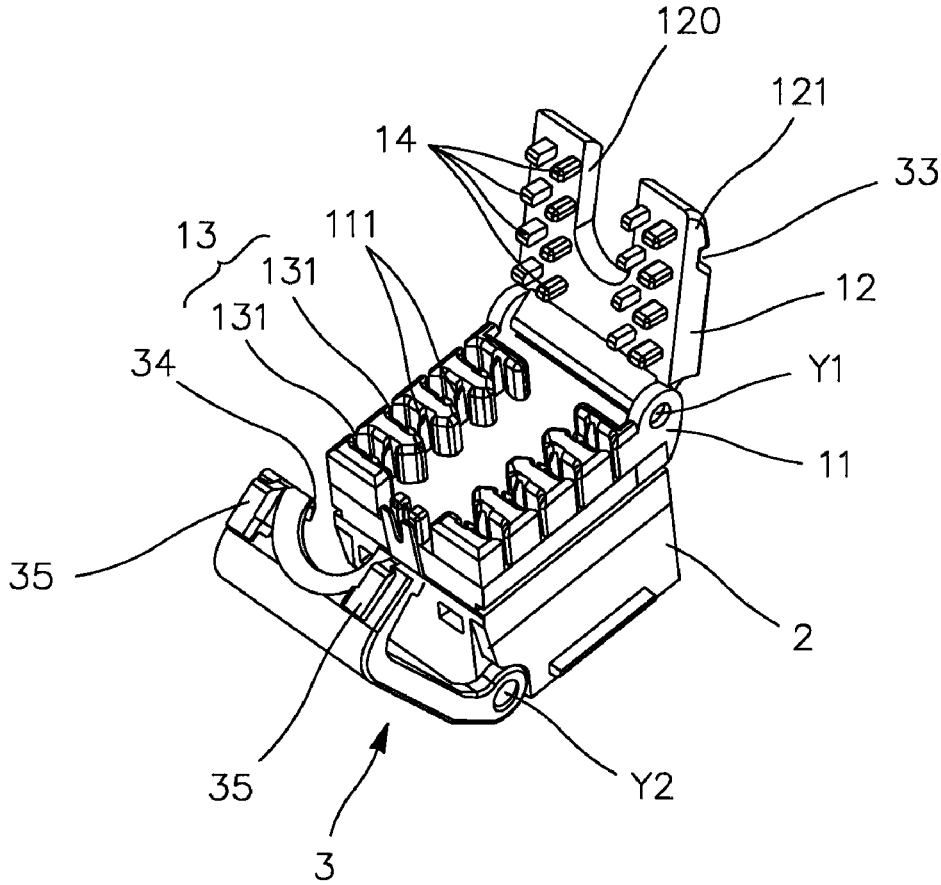
FIG. 9 is a perspective view of a connector according to a third possible embodiment of the invention, shown without a cable and in the open configuration of the grip.

The rack 13 may be held by the free portion 12 of the grip 1, as shown in FIGS. 1 to 8, but it may also be held by the connected portion 11 of this grip, as shown in FIG. 9.

The counter-rack 14, when it is present (FIG. 9), is formed by sections in relief, wherein each of which is designed to push a conductor C of the cable K into the corresponding notch 131 of the rack 13, wherein this counter-rack is thus fitted onto the portion 11 or 12 of the grip 1 opposite the portion holding the rack 13.

Even though the self-stripping electrical contacts 111 may a priori be held by one of the free 12 and connected 11 portions of the grip 1, it is advantageous to provide that they are held by the free portion 11, which permits each of these contacts 111 to be electrically connected more easily to a corresponding internal contact of the socket 2.

Each of the self-stripping contacts 111 is adapted to accommodate and strip, during an assembly phase of the connector including the closing of the grip 1, a corresponding insulated conductor C of the cable K.

Figure 3:
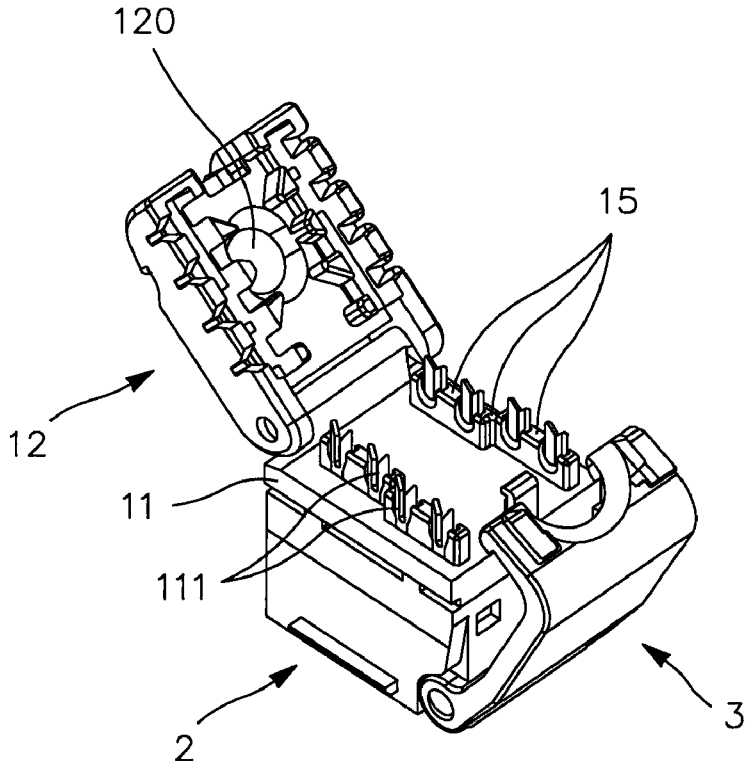
FIG. 3 is a perspective view of a connector according to a second possible embodiment of the invention, shown without a cable and in the open configuration of the grip.

As shown in FIG. 3, sections in relief 15 may be provided to protect the self-stripping contacts 111.

The function of the assembly means, at minimum, is to make possible, in the assembled configuration of the connector, the reversible attachment, one onto the other, of the free 12 and connected 11 portions of the grip 1.

According to the invention, the assembly means comprise a second articulation axis Y2 and a lever 3.

The second articulation axis Y2, which is held by the socket 2, is distant from the first articulation axis Y1 of the grip 1 along the longitudinal axis X and/or transversally to this longitudinal axis X.

In particular, the articulation axes Y1 and Y2 may be located on a same face of the socket.

In the case, illustrated by all of the figures, where the grip 1 and the socket 2 together form a substantially parallelepipedal stack, articulation axes Y1 and Y2 may however be substantially positioned on two diagonally opposed corners of this stack.

The lever 3 has a first end 31 that is articulated around the second articulation axis Y2, and a second end 32 that is distant from the first end 31 and that is curved.

Figure 4:
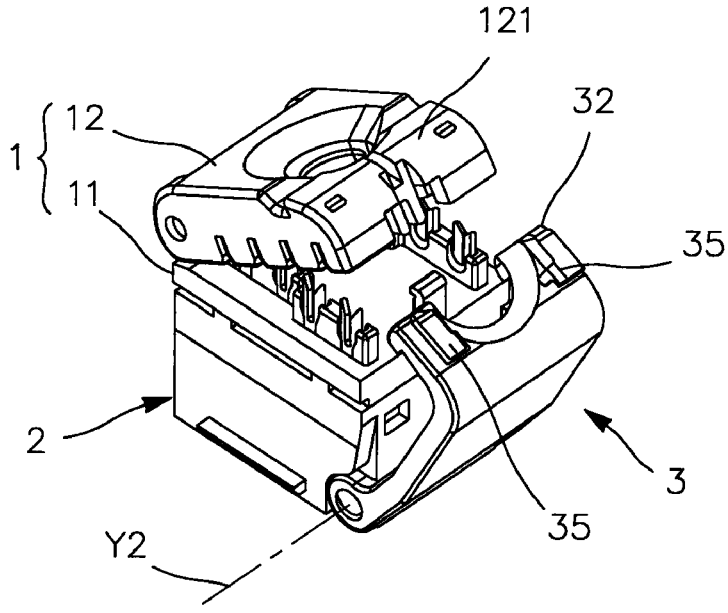
FIG. 4 is a perspective view of the connector of FIG. 3, shown in the closing phase of the grip.
Figure 5:
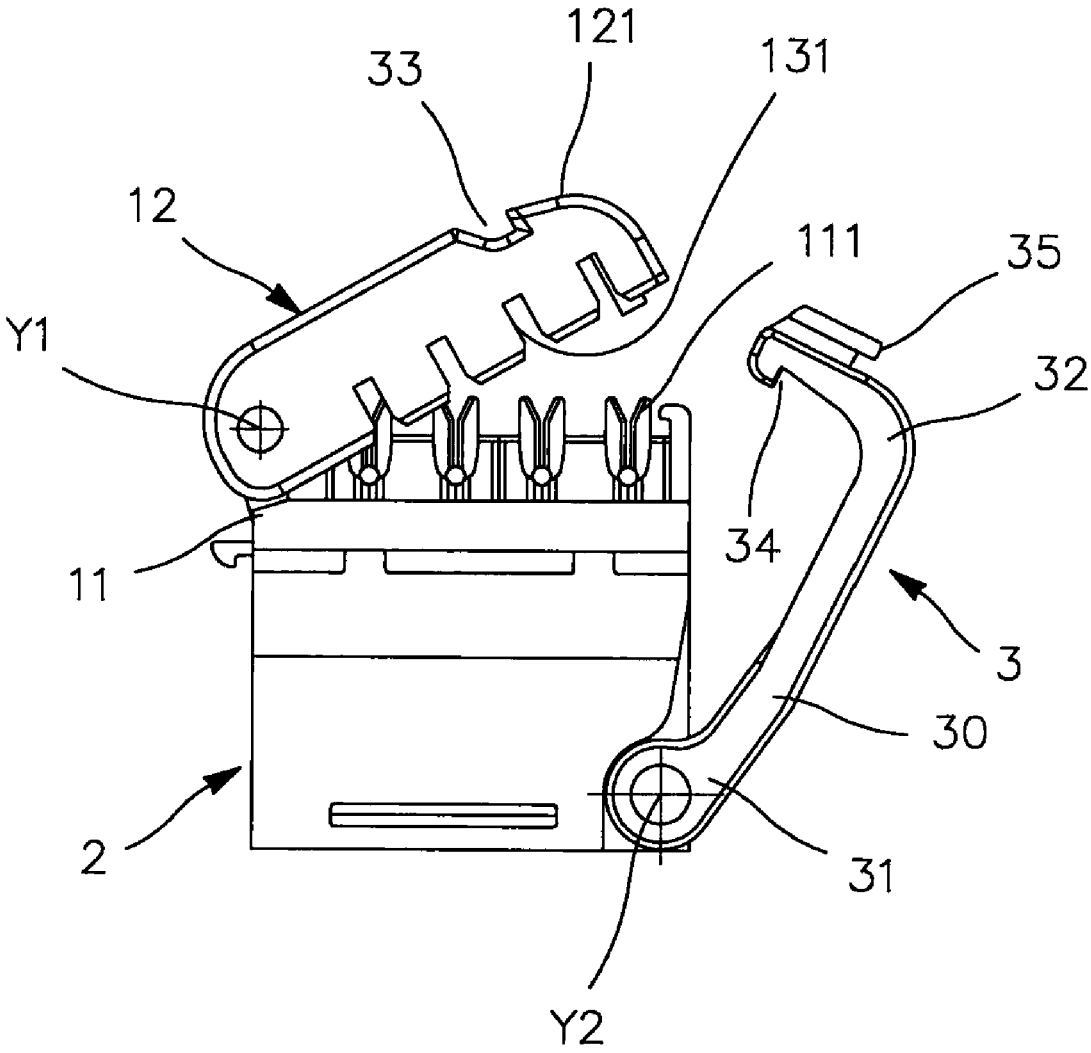
FIGS. 5 and 6 are side views of a connector according to the second embodiment of the invention, respectively shown before and after the closing operation of the grip.
Figure 6:
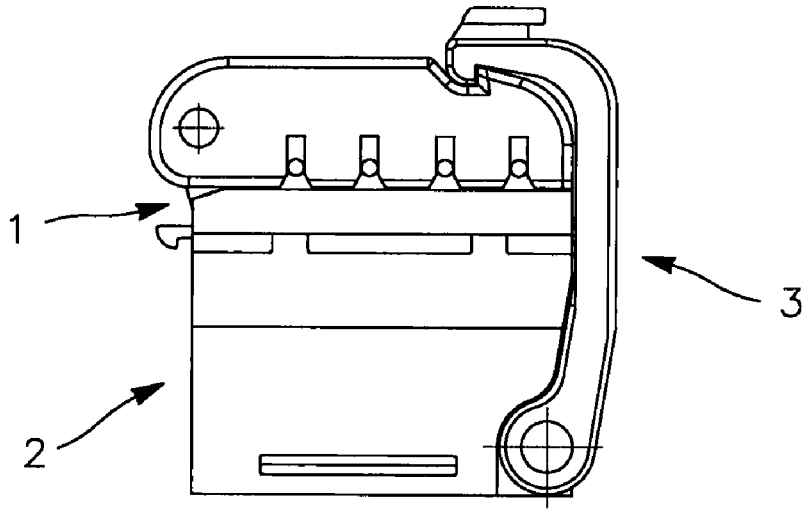
Figure 7:
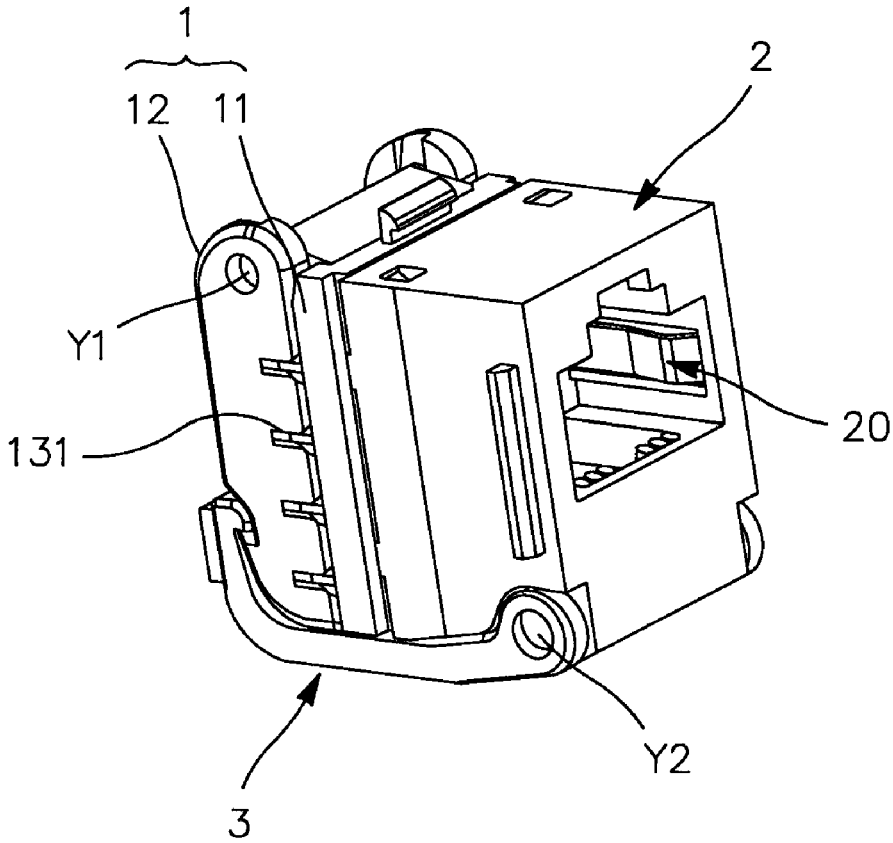
FIGS. 7 and 8 are perspective views from different angles of the connector of FIGS. 5 and 6, shown in the closed configuration of the grip.
Figure 8:
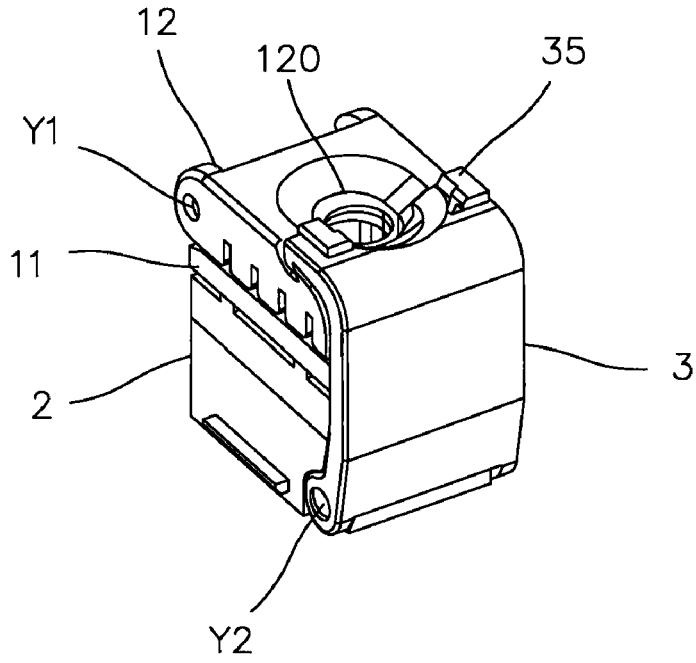

The free portion 12 of the grip 1 has an external surface 121 that is conformed into a slope, for example a slope with a decreasing angle from the front edge of this portion 12, as is most clearly shown in FIG. 4.

The surface 121 that is thus conform permits, during the assembly phase of the connector, a rotational torque applied to the lever 3 around the second articulation axis Y2 to be transformed into a thrust force that this surface 121 receives from the curved end 32 of the lever 3 and which solicits the grip 1 when closing.

To make more comfortable the pressure exerted by an operator on the lever 3 to apply the required rotational torque around the articulation axis Y2, this lever 3 preferably has a flat median section 30, extending between the ends 31 and 32 of this lever.

Furthermore, the external surface 121 of the free portion 12 of the grip 1 and the curved end 32 of the lever 3 advantageously has respective and complementary sections in relief that clip together, such as 33 and 34, which allow the lever 3 to be gripped or make it easier to be gripped in the closed configuration of the grip 1.

Finally, gripping lugs 35 may be provided on the curved end of the lever 3 to allow the lever to be moved from its position in the closed configuration of the grip to its released position, allowing this grip to be opened.

What is claimed is:

1. A connector designed to be fitted to a multi-conductor cable and which comprises a cable grip, a socket and assembly means wherein the socket is equipped with a plurality of internal contacts and has a connector face designed to accommodate a multi-conductor removable plug, wherein the grip forms a stack with the socket and comprises a portion that is connected to the socket, a free portion, a rack held on one of the free and connected portions, possibly a counter-rack held on the other one of the free and connected portions, and a plurality of self-stripping electrical contacts held by one of the free and connected portions, wherein the free portion has an passage designed to allow the cable to pass in a longitudinal axis and is articulated on the connected portion around a first articulation axis to permit selectively the opening or closing of the grip, wherein the rack has notches, each of which is dimensioned to hold a corresponding insulated conductor of the cable, wherein each of the self-stripping contacts is electrically connected with a corresponding internal contact of the socket and is adapted to accommodate and strip, during a phase where the connector is assembled, including the closing of the grip, a corresponding insulated conductor of the cable, and the assembly means which provide, in the assembled configuration of the connector, a reversible attachment of the free the free and connected portions of the grip, characterised in that the assembly means comprise a second articulation axis and a lever, in that the second articulation axis is held by the socket and distant from the first articulation axis along the longitudinal axis and/or transversally to the longitudinal axis, and in that the lever has a first end that is articulated around the second articulation axis and a second end, distant from the first and curved, wherein the free portion of the grip has an external surface that is conformed into a slope to transform, in the assembly phase, a rotational torque applied to the lever around the second articulation axis into a thrust force from the curved end of the lever which solicits the grip when closing.

2. A connector of claim 1, characterised in that the lever has between its ends, a flat median section.

3. The connector of claim 1, characterised in that the external surface of the free portion of the grip and the curved end of the lever have respective sections in relief that are complementary to one another so as to be clipped together.

4. The connector of claim 1, characterised in that the stack formed by the grip and the socket is substantially parallelepipedal.

5. The connector of claim 4, characterised in that the connected portion of the grip is connected to the socket at the opposite side to the connection face of this socket.

6. The connector of claim 4, characterised in that the first and second articulation axes may be substantially positioned on two diagonally opposed corners of the parallelepipedal stack.

7. The connector of claim 1, characterised in that the self-stripping electrical contacts are held by the connected portion of the grip.

8. The connector of claim 1, characterised in that the passage is in the form of a notch.

* * * * *